US010533561B2

(12) United States Patent
Horng et al.

(10) Patent No.: US 10,533,561 B2
(45) Date of Patent: Jan. 14, 2020

(54) CEILING FAN

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Bo-Wei Chiou, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 171 days.

(21) Appl. No.: 15/613,331

(22) Filed: Jun. 5, 2017

(65) Prior Publication Data

US 2017/0370367 A1 Dec. 28, 2017

(30) Foreign Application Priority Data

Jun. 28, 2016 (TW) ..... 105120347 A
Sep. 1, 2016 (TW) ..... 105128297 A

(51) Int. Cl.

*F04D 25/08* (2006.01)
*F04D 25/06* (2006.01)
*F04D 25/16* (2006.01)
*F04D 29/051* (2006.01)
*F04D 25/00* (2006.01)

(52) U.S. Cl.

CPC ..... *F04D 25/088* (2013.01); *F04D 25/06* (2013.01); *F04D 25/166* (2013.01); *F04D 29/0513* (2013.01); *F04D 25/00* (2013.01); *F04D 25/08* (2013.01)

(58) Field of Classification Search

CPC .... F04D 25/06; F04D 25/0613; F04D 25/088; F04D 25/166; F04D 29/0513; F04D 29/329

See application file for complete search history.

(56) References Cited

U.S. PATENT DOCUMENTS 6,036,331 A * 3/2000 Acquisto ..... F04D 25/088 362/234
6,390,777 B1 5/2002 Kerr, Jr.
7,284,960 B2 10/2007 Aynsley
9,605,685 B2 3/2017 Wang
9,841,029 B2 * 12/2017 Yin ..... F04D 25/088
2015/0176588 A1 * 6/2015 Yin ..... F04D 25/088 310/90
2016/0111940 A1 4/2016 Oyama et al.

(Continued)

FOREIGN PATENT DOCUMENTS

CN 101408194 A 4/2009
CN 203660757 U 6/2014

(Continued)

*Primary Examiner* — Patrick Hamo

(74) *Attorney, Agent, or Firm* — Alan D. Kamrath; Karin L. Williams; Mayer & Williams PC

(57) ABSTRACT

A ceiling fan is designed with enhanced structural strength and prolonged service life. The ceiling fan includes a stator, a loading plate, a rotor and a plurality of blades is disclosed. The stator includes a shaft. The loading plate includes a sleeve and a radial extending portion. The radial extending portion radially extends outwards in radial directions of the shaft. The sleeve receives a bearing coupled with an outer periphery of the shaft. The rotor includes a hub coupled with the loading plate. The plurality of blades is coupled with the radial extending portion.

29 Claims, 12 Drawing Sheets

(56) References Cited

U.S. PATENT DOCUMENTS

| | | | | |
|---|---|---|---|---|
| 2016/0131152 | A1 | 5/2016 | Wang | |
| 2018/0347573 | A1* | 12/2018 | Horng | F04D 25/062 |

FOREIGN PATENT DOCUMENTS

| | | | |
|---|---|---|---|
| CN | 203939763 | U | 11/2014 |
| CN | 105090100 | A | 11/2015 |
| JP | H11132192 | A | 5/1999 |
| JP | 3803475 | B2 | 8/2006 |
| TW | M434130 | U | 7/2012 |
| TW | M497387 | U | 3/2015 |
| WO | WO9622628 | A1 | 7/1996 |

* cited by examiner

CEILING FAN

CROSS REFERENCE TO RELATED APPLICATIONS

The application claims the benefit of Taiwan application serial No. 105120347 and 105128297, respectively filed on Jun. 28, 2016 and Sep. 1, 2016, and the entire contents of which are incorporated herein by reference.

BACKGROUND OF THE INVENTION

1. Field of the Invention

The present invention generally relates to a ceiling fan and, more particularly, to a ceiling fan having a loading plate.

2. Description of the Related Art

FIG. 1 shows a conventional ceiling fan 9. The conventional ceiling fan 9 includes a stator 91, a rotor 92, a sleeve 93 and a plurality of blades 94. The stator 91 has a shaft 911. The rotor 92 has a hub 921. The sleeve 93 receives a bearing, such that the sleeve 93 is rotatably coupled with an outer periphery of the shaft 911. The hub 921 is coupled with the sleeve 93, as well as being rotatably coupled with the shaft 911. The plurality of blades 94 are coupled with the hub 921. As such, when the hub 921 is driven to rotate about the shaft 911, the air current can be generated under the rotation of the plurality of blades 94.

In order to ensure a sufficient air-driving effect, each of the plurality of blades 94 is usually large and heavy. Since the plurality of blades 94 is coupled with the hub 921, the hub 921 has to support the total weight of the plurality of blades 94, which is considerably heavy. The hub 921 is coupled with the sleeve 93 by ways of screwing, tenoning etc. As such, heavy weight supported by the hub 921 may cause the interconnected part between the hub 921 and the sleeve 93 to come loose or deformed after a long term of use. Therefore, the structural strength of the conventional ceiling fan 9 is weak and the service life thereof is short.

In light of this, it is necessary to provide a novel ceiling fan, so as to enhance the structural strength of the ceiling fan and prolong the service life of the ceiling fan.

SUMMARY OF THE INVENTION

It is therefore the objective of this invention to provide a novel ceiling fan including a loading plate, the loading plate including a sleeve and a radial extending portion. Through the arrangement of the radial extending portion on the loading plate, the plurality of blades may be coupled with the radial extending portion. Thus, it is unnecessary for a hub to support the total weight of a plurality of blades.

In an embodiment of the invention, a ceiling fan is disclosed. The ceiling fan includes a stator, a loading plate, a rotor and a plurality of blades is disclosed. The stator includes a shaft. The loading plate includes a sleeve and a radial extending portion. The radial extending portion radially extends outwards in radial directions of the shaft. The sleeve receives a bearing coupled with an outer periphery of the shaft. The rotor includes a hub coupled with the loading plate. The plurality of blades are coupled with the radial extending portion.

In a preferred form shown, the shaft includes a first end, a second end and a shoulder portion with a surface facing the first end. The bearing is disposed on the shoulder portion. As such, the shoulder portion is able to support the weight of the loading plate via the bearing.

In a preferred form shown, the bearing includes an inner ring and an outer ring. The inner ring is coupled with the outer periphery of the shaft and abuts against the shoulder portion. The outer ring is coupled with the sleeve. As such, since the outer ring is able to pivot about the inner ring, the loading plate is able to be rotatably coupled with the shaft via the sleeve.

In a preferred form shown, the shaft includes a first end and a second end. The hub is coupled with a surface of the sleeve adjacent to the second end. As such, the rotor is able to couple with the loading plate.

In the preferred form shown, a side of the sleeve adjacent to the first end has a first lateral edge, and another side of the sleeve has a second lateral edge. The radial extending portion is formed on the second lateral edge. As such, the hub is able to couple with the radial extending portion to reinforce the coupling effect between the hub and the loading plate.

In the preferred form shown, a first surface and a second surface are respectively formed on two sides of the radial extending portion in an axial direction of the shaft. The first surface and the second surface respectively face the first end and the second end. The hub is coupled with the second surface, and the plurality of blades is coupled with the first surface. As such, the coupling effect between the hub and the loading plate is effectively enhanced.

In the preferred form shown, a first surface and a second surface are respectively formed on two sides of the radial extending portion in an axial direction of the shaft. The first surface and the second surface respectively face the first end and the second end. The second surface is spaced from the hub by a gap. The plurality of blades are coupled with one of the first surface and the second surface. Based on this, the plurality of blades may be coupled with one of the first and second surfaces, enabling the ceiling fan, according to the preferred embodiment, to fit in environments with different height limits. Therefore, the ceiling fan according to the preferred embodiment provides improved utility.

In the preferred form shown, the radial extending portion is arranged between the first lateral edge and the second lateral edge. Alternatively, the radial extending portion is formed on the first lateral edge. As such, the gap can thus be formed between the second surface of the radial extending portion and the hub.

In the preferred form shown, the ceiling fan further includes a cover board. The cover board abuts against a side of each of the plurality of blades located distant to the radial extending portion. As such, the radial extending portion and the cover board are able to clamp each of the plurality of blades from both sides in the axial direction of the shaft.

In the preferred form shown, the cover board fully or partially covers an overlap between each of the plurality of blades and the radial extending portion. As such, the contact area between each of the plurality of blades and the radial extending portion and the contact area between each of the plurality of blades and the cover board are both larger, obtaining an even better coupling effect by clamping each of the plurality of blades from both sides with the radial extending portion and the cover board.

In the preferred form shown, the radial extending portion includes a plurality of first coupling portions, and each of the plurality of blades includes a second coupling portion. Each of the plurality of first coupling portions is coupled with the second coupling portion of a respective one of the plurality of blades. As such, each of the plurality of blades can be firmly coupled with the radial extending portion.

In the preferred form shown, the ceiling fan further includes a cover board, wherein the cover board abuts against a side of each of the plurality of blades located distant to the radial extending portion, wherein the cover board includes a plurality of third coupling portions, and wherein each of the plurality of third coupling portions is coupled with a respective one of the plurality of first coupling portions and the second coupling portion of a respective one of the plurality of blades. As such, the radial extending portion and the cover board are able to clamp each of the plurality of blades from both sides.

In the preferred form shown, the first coupling portion has a screw hole, wherein each of the second coupling portion and the third coupling portion has a through hole, wherein a fixing member extends through the through holes of the second coupling portion and the third coupling portion, and wherein the fixing members is coupled with a wall of the screw hole of the first coupling portion. As such, the radial extending portion and the cover board are able to clamp each of the plurality of blades from both sides.

In the preferred form shown, the hub includes a top wall and a lateral wall formed on an outer periphery of the top wall. The top wall has a midpoint in one of the radial directions of the shaft. The midpoint is located at the middle of the outer periphery and an inner periphery of the top wall, and the radial extending portion extends beyond the midpoint in the radial direction. As such, the radial extending portion may provide sufficient surface area for the plurality of blades to contact, enlarging the contact area between each of the plurality of blades and the radial extending portion and further ensuring a stable coupling effect between the plurality of blades and the radial extending portion.

In the preferred form shown, each of the plurality of blades has an extending direction. An overlap between each of the plurality of blades and the radial extending portion has a length in the extending direction, and the length is larger than a distance between the midpoint and the outer periphery of the top wall. As such, the contact area between each of the plurality of blades and the radial extending portion is larger, obtaining a better coupling effect between the plurality of blades and the radial extending portion.

In the preferred form shown, the sleeve receives a secondary bearing. The shaft includes another shoulder portion facing the second end. The secondary bearing is disposed on the other shoulder portion. The size of the secondary bearing is larger than the size of the bearing. Based on this, the secondary bearing is able to come into contact with the sleeve and to absorb the falling momentum of the loading plate and the rotor if the outer ring of the bearing broke and dropped, reducing the potential damage to the ceiling fan.

In the preferred form shown, each of the plurality of blades includes a fixing portion and an air driving portion. A side of the fixing portion is coupled with the radial extending portion of the loading plate, and another side of the fixing portion extends beyond the radial extending portion to couple with the air driving portion. Based on this, each of the plurality of blades is able to couple with the radial extending portion via the fixing portion, thereby preventing the thickness or shape of the air driving portion from limiting by the radial extending portion. Therefore, the production complexity of the plurality of blades can be reduced.

In the preferred form shown, the radial extending portion includes a plurality of first coupling portions, and the fixing portion of each of the plurality of blades includes a second coupling portion. Each of the plurality of first coupling portions is coupled with the second coupling portion of the fixing portion of a respective one of the plurality of blades. As such, each of the plurality of blades is able to couple with the radial extending portion via the fixing portion.

In the preferred form shown, the ceiling fan further includes a cover board. The cover board abuts against a side of the fixing portion of each of the plurality of blades located distant to the radial extending portion. The cover board includes a plurality of third coupling portions. Each of the plurality of third coupling portions is coupled with a respective one of the plurality of first coupling portions and the second coupling portion of the fixing portion of a respective one of the plurality of blades. As such, the radial extending portion and the cover board are able to clamp the fixing portion of each of the plurality of blades from both sides.

In the preferred form shown, the air driving portion includes a receiving portion having an opening facing the loading plate. The fixing portion extends into the receiving portion. As such, the fixing portion is able to extend into the receiving portion and to couple with the air driving portion, so as to enhance the structural strength of the combination between the fixing portion and the air driving portion.

In the preferred form shown, the fixing portion has a first section and a second section. The first section is exposed out of the air driving portion, and the second section is received inside the receiving portion. The second coupling portion is formed on the first section. As such, the first section of the fixing portion is able to couple with the radial extending portion, and the second section of the fixing portion is able to extend into the receiving portion and to couple with the air driving portion, so as to enhance the structural strength of the combination between the fixing portion and the air driving portion.

In the preferred form shown, the second section has a first assembling portion, and the air driving portion has a second assembling portion coupled with the first assembling portion. As such, the second section of the fixing portion is able to couple with the air driving portion through the first and second assembling portions.

In the preferred form shown, each of the plurality of blades has an extending direction. An overlap between the first section of the fixing portion of each of the plurality of blades and the radial extending portion has a length in the extending direction. The second section of the fixing portion has an extending length in the extending direction. The extending length is a length of an overlap between the fixing portion and the air driving portion. The length is larger than the extending length. As such, the contact area between each of the plurality of blades and the radial extending portion is larger, and the torque received by first section is reduced, preventing the coupling effect between the second coupling portion and the first coupling portions of the radial extending portion from decreasing.

In a preferred form shown, the hub includes a top wall and a lateral wall formed on an outer periphery of the top wall, wherein the top wall has a midpoint in one of the radial directions of the shaft, wherein the midpoint is located at the middle of the outer periphery and an inner periphery of the top wall, wherein the radial extending portion extends beyond the midpoint in the radial direction, and wherein the length is larger than a distance between the midpoint and the outer periphery of the top wall. As such, the radial extending portion may provide sufficient surface area for the plurality of blades to contact, enlarging the contact area between the first section of each of the plurality of blades and the radial extending portion and further ensuring a stable coupling effect between the plurality of blades and the radial extending portion.

In the preferred form shown, the fixing portion has a first positioning member, and an inner surface of the air driving portion facing the receiving portion has a second positioning member. The first positioning member and the second positioning member respectively extend in an extending direction of each of the plurality of blades. The first positioning member is movably coupled with the second positioning member. As such, the first and second positioning members are able to limit a direction in which the relative move between the fixing portion and the air driving portion can be made, thereby allowing the second section of the fixing portion to easily extend into the receiving portion of the air driving portions, and further providing a convenient assembly of each of the plurality of blades.

In the preferred form shown, the air driving portion is a hollow plate formed by aluminum extrusion. Based on this, it takes only one aluminum extrusion die to produce air driving portions with different lengths by aluminum extrusion and shearing processes, sufficiently reducing the production cost of the blades with different lengths. Thus, the ceiling fan according to the embodiment of is able to be carried out as different products, such as products having blades with different lengths, in order to fulfill the specific requirement of different locations.

Based on the above structure, through the arrangement of the radial extending portion on the loading plate, the plurality of blades is coupled with the radial extending portion. In this regard, the weight supported by the hub of the rotor is reduced. Therefore, the interconnected part between the hub and the loading plate will not come loose or deformed due to the weight supported by the hub. Advantageously, the structural strength of the ceiling fan is enhanced, as well as the service life of the ceiling fan is prolonged.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
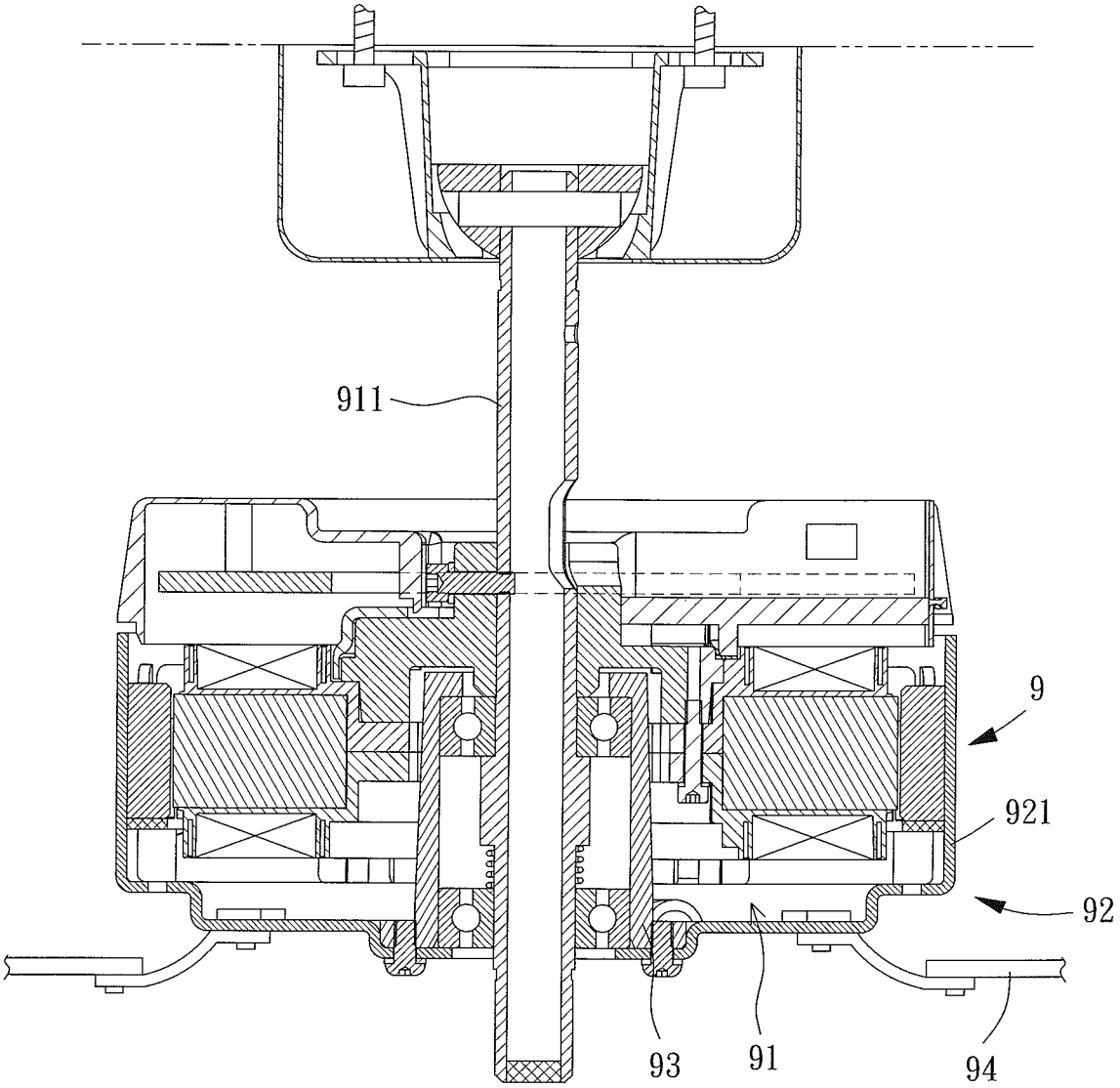
FIG. 1 PRIOR ART
FIG. 1 is a cross sectional view of a conventional ceiling fan.

In the various figures of the drawings, the same numerals designate the same or similar parts. Furthermore, when the terms "first", "second", "third", "inner", "outer", "top", and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
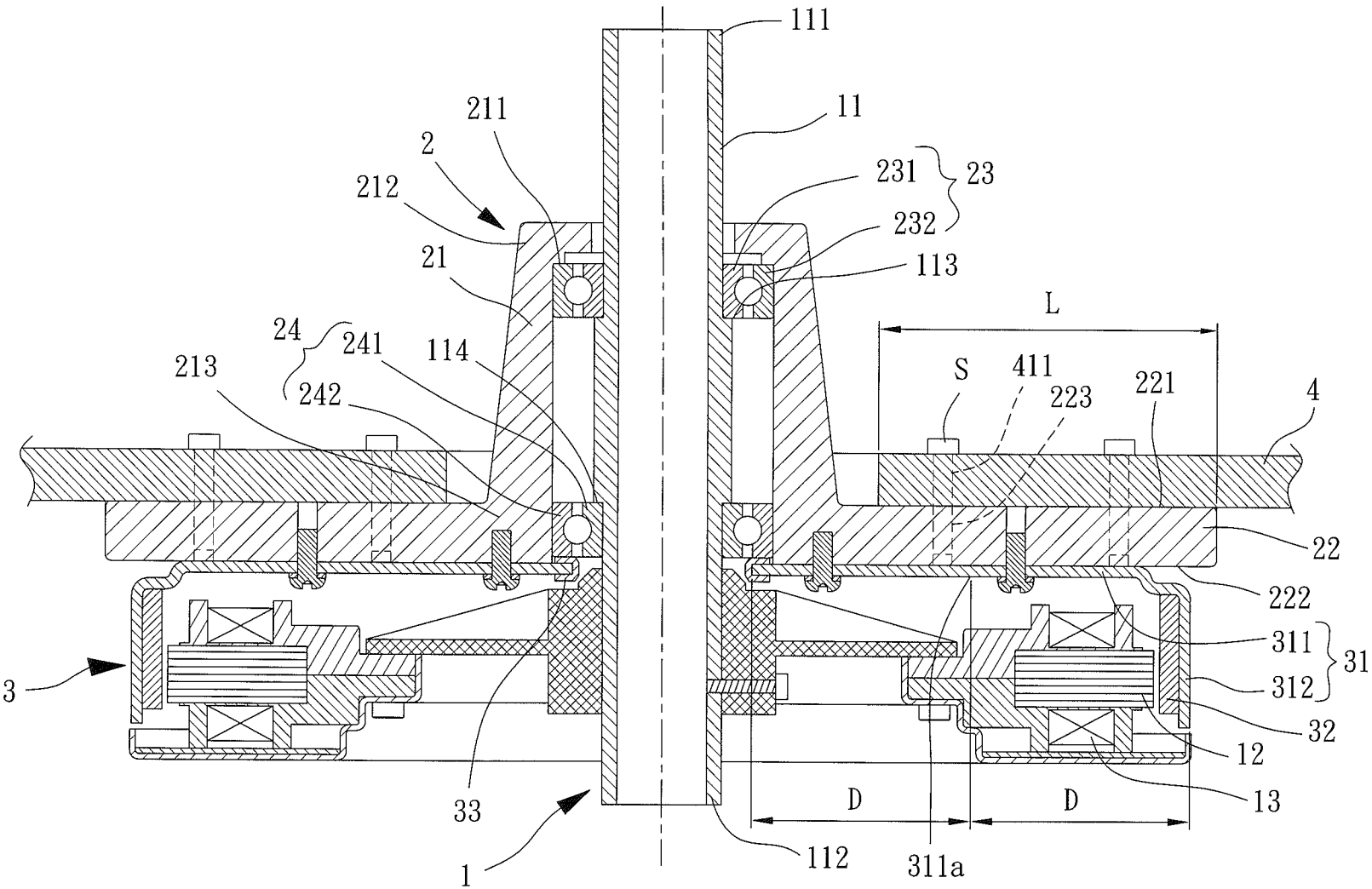
FIG. 2 is a cross sectional view of a ceiling fan according to a first embodiment of the invention.

FIG. 2 is a cross sectional view of a ceiling fan according to a first embodiment of the invention. The ceiling fan includes a stator 1, a loading plate 2, a rotor 3 and a plurality of blades 4. The loading plate 2 is rotatably coupled with the stator 1. The rotor 3 and the plurality of blades 4 are coupled with the loading plate 2.

The stator 1 includes a shaft 11 and an iron core 12. The shaft 11 includes a first end 111 and a second end 112 opposite to each other in an axial direction of the shaft 11. The iron core 12 is fixed to the shaft 11, and a coil unit 13 can be wound around the iron core 12.

The loading plate 2 includes a sleeve 21 and a radial extending portion 22. The radial extending portion 22 is formed on the sleeve 21. The radial extending portion 22 radially extends outwards in radial directions of the shaft 11. The radial extending portion 22 can be integrally formed with the sleeve 21 to reinforce the structural strength of the loading plate 2. The shaft 11 extends into the sleeve 21. The sleeve 21 receives a bearing 23. The bearing 23 is coupled with an outer periphery of the shaft 11, such that the loading plate 2 is rotatably coupled with the shaft 11. The shaft 11 further includes a shoulder portion 113 facing the first end 111. The bearing 23 includes an inner ring 231 and an outer ring 232. The inner ring 231 is coupled with the outer periphery of the shaft 11 and abuts against the shoulder portion 113. The outer ring 232 is coupled with an inner surface of the sleeve 21. As such, the shoulder portion 113 is able to support the weight of the loading plate 2 via the bearing 23. Besides, the outer ring 232 is able to pivot about the inner ring 231, allowing the loading plate 2 to be rotatably coupled with the shaft 11 via the sleeve 21.

The sleeve 21 can further includes a retaining portion 211 located at a side of the sleeve 21 adjacent to the first end 111. The retaining portion 211 extends inwards to the shaft 11 and abuts against a surface of the outer ring 232 facing the first end 111. As such, the retaining portion 211 and the shoulder portion 113 of the shaft 11 are able to provide a preload force for the bearing 23 from both sides.

The rotor 3 includes a hub 31. The hub 31 is coupled with the loading plate 2. In this embodiment, the hub 31 can be coupled with a surface of the sleeve 21 adjacent to the second end 112. The hub 31 includes a top wall 311 and a lateral wall 312. The lateral wall 312 is formed on an outer periphery of the top wall 311. The top wall 311 may be integrally formed with the lateral wall 312. Instead, the top wall 311 may also be coupled with the lateral wall 312 by ways of engagement or screwing. The invention is not limited to either implementation. The top wall 311 is able to couple with the sleeve 21. A permanent magnet unit 32 may be coupled with an inner peripheral surface of the lateral wall 312 and is spaced from the iron core 12 of the stator 1 by an air gap.

Each of the plurality of blades 4 is coupled with the radial extending portion 22 of the loading plate 2. The radial extending portion 22 includes a plurality of first coupling portions 223, and each of the plurality of blades 4 includes a second coupling portion 411. Each of the plurality of first coupling portions 223 is coupled with the second coupling portion 411 of a respective one of the plurality of blades 4. As such, each of the plurality of blades 4 can be firmly coupled with the radial extending portion 22.

When the ceiling fan according to the first embodiment of the invention is in use, the shaft 11 may be fixed to a predetermined location such as the ceiling or the wall in order to fix the ceiling fan. The loading plate 2 is rotatably coupled with the stator 1, and the rotor 3 is coupled with the loading plate 2. Based on this, the iron core 12 of the stator 1 may be magnetically linked with the permanent magnet unit 32 of the rotor 3 after the coil unit 13 is electrified. In this regard, the stator 1 is able to drive the hub 31 and the loading plate 2 to rotate, such that the air current can be generated under the rotation of the plurality of blades 4.

From the above, since the loading plate 2 includes the radial extending portion 22, the plurality of blades 4 is directly coupled with the radial extending portion 22, so as to reduce the weight supported by the hub 31 of the rotor 3. As such, the interconnected part between the hub 31 and the sleeve 21 of the loading plate 2 will not come loose or deformed after a long term of use.

Based on the above structure, various features of the ceiling fan according to embodiments of the invention are elaborated below.

Specifically, a first surface 221 and a second surface 222 are respectively formed on two sides of the radial extending portion 22 in the axial direction of the shaft 11. The first surface 221 faces the first end 111 of the shaft 11, and the second surface 222 faces the second end 112 of the shaft 11. In this embodiment, the radial extending portion 22 can be coupled with a side of the sleeve 21 adjacent to the second end 112 (i.e. the side of the sleeve 21 adjacent to the hub 31). Therefore, the top wall 311 of the hub 31 may further be coupled with the second surface 222 of the radial extending portion 22 to reinforce the coupling effect between the hub 31 and the loading plate 2. The plurality of blades 4 is coupled with the first surface 221 of the radial extending portion 22.

Particularly, in the conventional ceiling fan 9, the outer surface of the hub 921 may not be flat since the shape of the hub 921 must be adapted to accommodate the component received inside the hub 921 such as an iron core or a permanent magnet. Moreover, the outer surface of the hub 921 may include additional structure such as a heat dissipating hole. Thus, the contact area between each of the plurality of blades 94 and the hub 921 may be small, leading to undesirable coupling effect between the plurality of blades 94 and the hub 921.

Contrarily, in this embodiment, since the first surface 221 of the radial extending portion 22 is merely coupled with the plurality of blades 4, the first surface 221 may be in in the form of a plane surface, such that each of the plurality of blades 4 may directly abut against the radial extending portion 22 along the axial direction of the shaft 11. Referring to FIG. 2, the top wall 311 of the hub 31 has a midpoint 311*a* in one of the radial directions of the shaft 11. The midpoint 311*a* is located at the middle of the outer periphery and an inner periphery of the top wall 311. The radial extending portion 22 extends outward beyond the midpoint 311*a* in the radial direction of the shaft 11. As such, the radial extending portion 22 may provide sufficient surface area for the plurality of blades 4 to contact, enlarging the contact area between each of the plurality of blades 4 and the radial extending portion 22 and further ensuring a stable coupling effect between the plurality of blades 4 and the radial extending portion 22.

Moreover, each of the plurality of blades 4 has an extending direction. For example, the extending direction may be parallel to one of the radial directions of the shaft 11, and the extending direction may further be one of the radial directions of the shaft 11. An overlap between each of the plurality of blades 4 and the radial extending portion 22 has a length "L" in the extending direction. The length "L" is larger than a distance "D" between the midpoint 311*a* and the outer periphery (or inner periphery) of the top wall 311. As such, the contact area between each of the plurality of blades 4 and the radial extending portion 22 is larger, obtaining a better coupling effect between the plurality of blades 4 and the radial extending portion 22.

Figure 3:
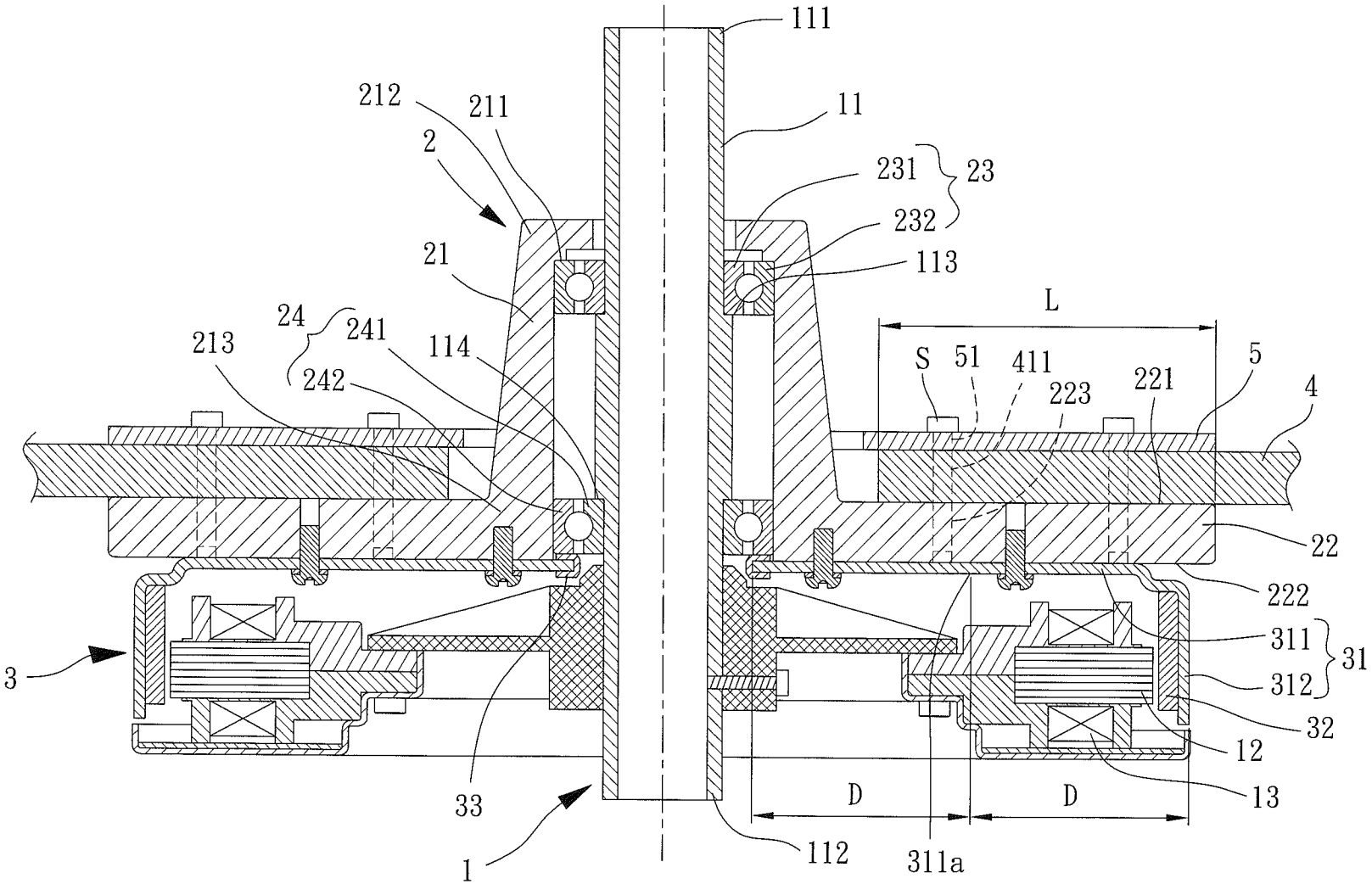
FIG. 3 is a cross sectional view of a ceiling fan according to a second embodiment of the invention.

Referring to FIG. 3, a ceiling fan according to a second embodiment of the invention is shown. The second embodiment differs from the first embodiment in that the ceiling fan further includes a cover board 5. The cover board 5 abuts against a side of each of the plurality of blades 4 located distant to the first surface 221. In this arrangement, the radial extending portion 22 and the cover board 5 can clamp each of the plurality of blades 4 from both sides in the axial direction of the shaft 11, enhancing the coupling effect between each of the plurality of blades 4 and the radial extending portion 22. Specifically, the cover board 5 includes a plurality of third coupling portions 51. Each of the plurality of third coupling portions 51 is coupled with a respective one of the plurality of first coupling portions 223 of the radial extending portion 22 and the second coupling portion 411 of a respective one of the plurality of blades 4, allowing the radial extending portion 22 and the cover board 5 to clamp each of the plurality of blades 4 from both sides. For example, the first coupling portion 223 can have a screw hole, each of the second coupling portion 411 and the third coupling portion 51 can have a through hole. A fixing member "S" extends through the through holes of the second coupling portion 411 and the third coupling portion 51, and the fixing members "S" is firmly coupled with a wall of the screw hole of the first coupling portion 223. As such, the radial extending portion 22 and the cover board 5 can clamp each of the plurality of blades 4 from both sides.

The cover board 5 is able to fully or partially cover the overlap between each of the plurality of blades 4 and the radial extending portion 22. In this arrangement, the contact area between each of the plurality of blades 4 and the radial extending portion 22 and the contact area between each of the plurality of blades 4 and the cover board 5 are both larger, obtaining an even better coupling effect by clamping each of the plurality of blades 4 from both sides with the radial extending portion 22 and the cover board 5.

Figure 4:
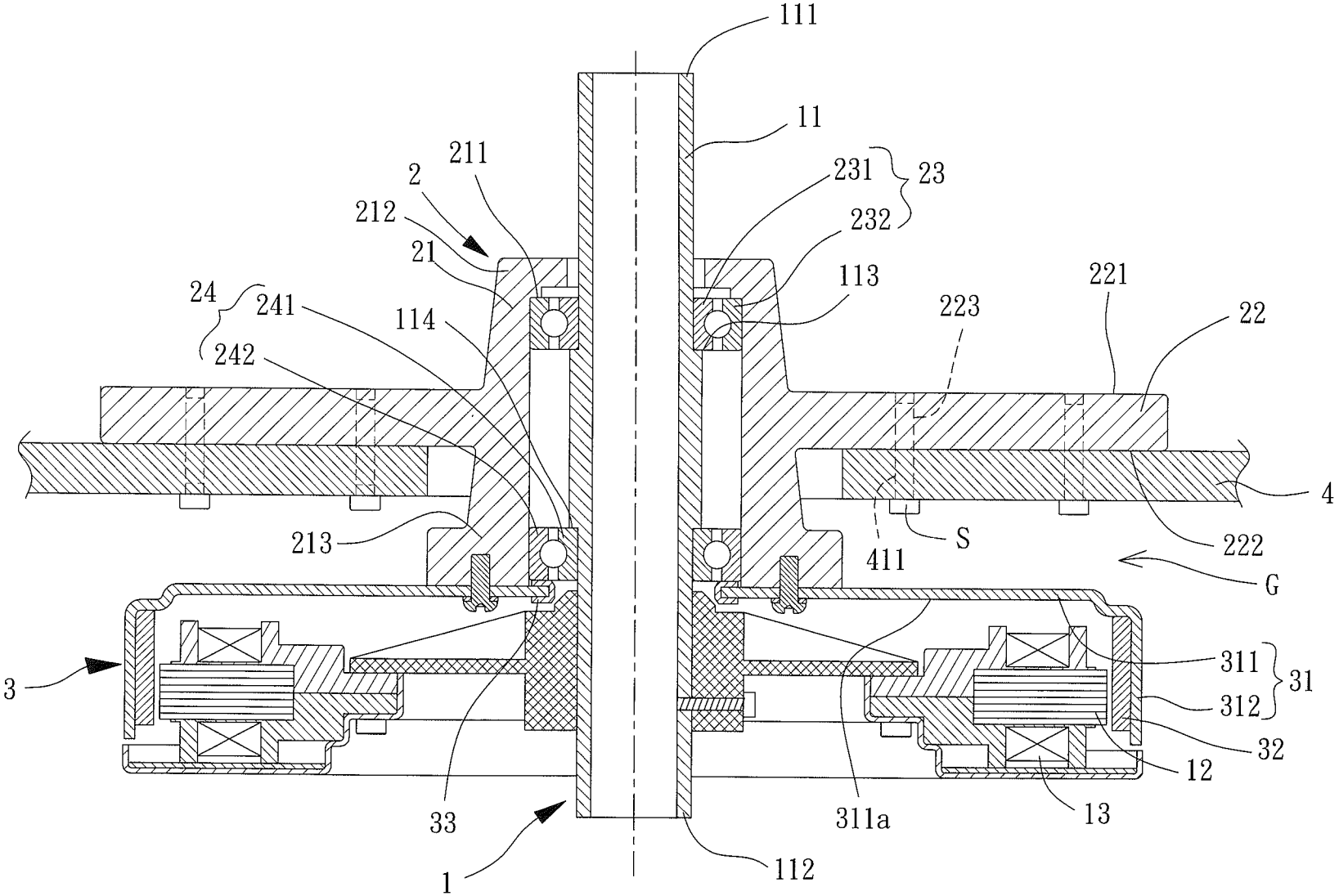
FIG. 4 is a cross sectional view showing a plurality of blades coupled with a second surface of a radial extending portion according to a third embodiment of the invention.
Figure 5:
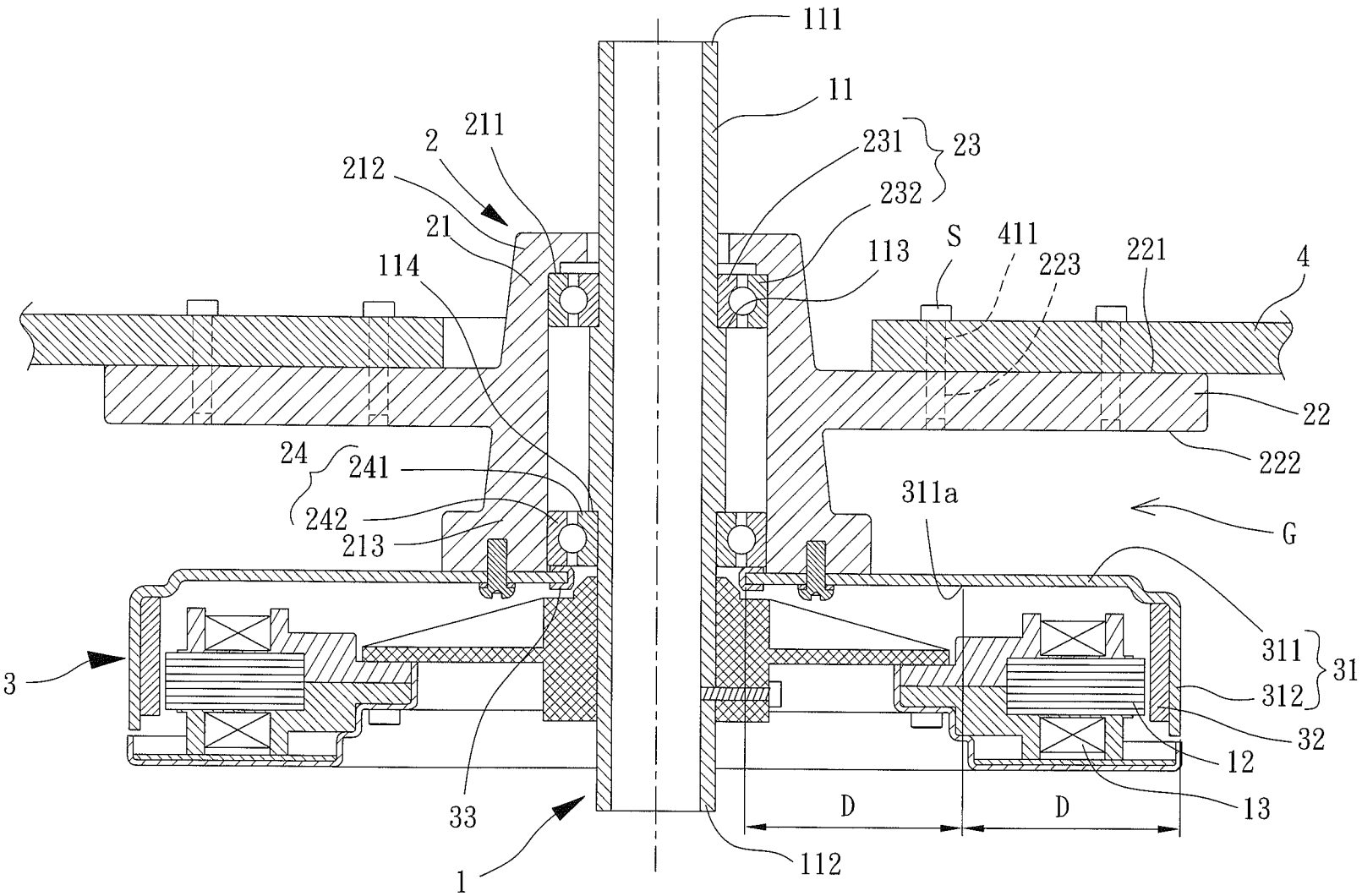
FIG. 5 is a cross sectional view showing the plurality of blades coupled with a first surface of the radial extending portion according to the third embodiment of the invention.

It has been described in the previous embodiments that the radial extending portion 22 is coupled with the side of the sleeve 21 adjacent to the second end 112, allowing the top wall 311 of the hub 31 to couple with the radial extending portion 22. However, referring to FIG. 4, a ceiling fan according to a third embodiment of the invention is shown. The third embodiment differs from the previous embodiments in that the second surface 222 of the radial extending portion 22 is spaced from the top wall 311 of the hub 31 by a gap "G". In this arrangement, each of the plurality of blades 4 is able to extend into the gap "G", allowing the plurality of blades 4 to couple with the second surface 222. Instead, referring to FIG. 5, the plurality of blades 4 can still be coupled with the first surface 221 with a gap "G" formed between the second surface 222 and the top wall 311. Accordingly, the plurality of blades 4 may be coupled with one of the first surface 221 and the second surface 222, enabling the ceiling fan according to the third embodiment to fit in environments with different height limits. As such, the ceiling fan according to the third embodiment provides an improved utility.

The side of the sleeve 21 adjacent to the first end 111 has a first lateral edge 212. The side of the sleeve 21 adjacent to the second end 112 has a second lateral edge 213. As stated above, in the first and second embodiments, the radial extending portion 22 may be formed on the second lateral edge 213; in the third embodiment, the radial extending portion 22 may be arranged between the first lateral edge 212 and the second lateral edge 213, such that a gap "G" is formed between the second surface 222 of the radial extending portion 22 and the top wall 311 of the hub 31. However, referring to FIG. 6, a ceiling fan according to a fourth embodiment of the invention is shown. The fourth embodiment differs from the previous third embodiment in that the radial extending portion 22 is coupled with the first lateral edge 212. In this arrangement, a gap "G" is also formed between the second surface 222 and the top wall 311, and the first surface 221 of the radial extending portion 22 is exposed. Accordingly, the plurality of blades 4 may still be coupled with one of the first surface 221 and the second surface 222.

Figure 6:
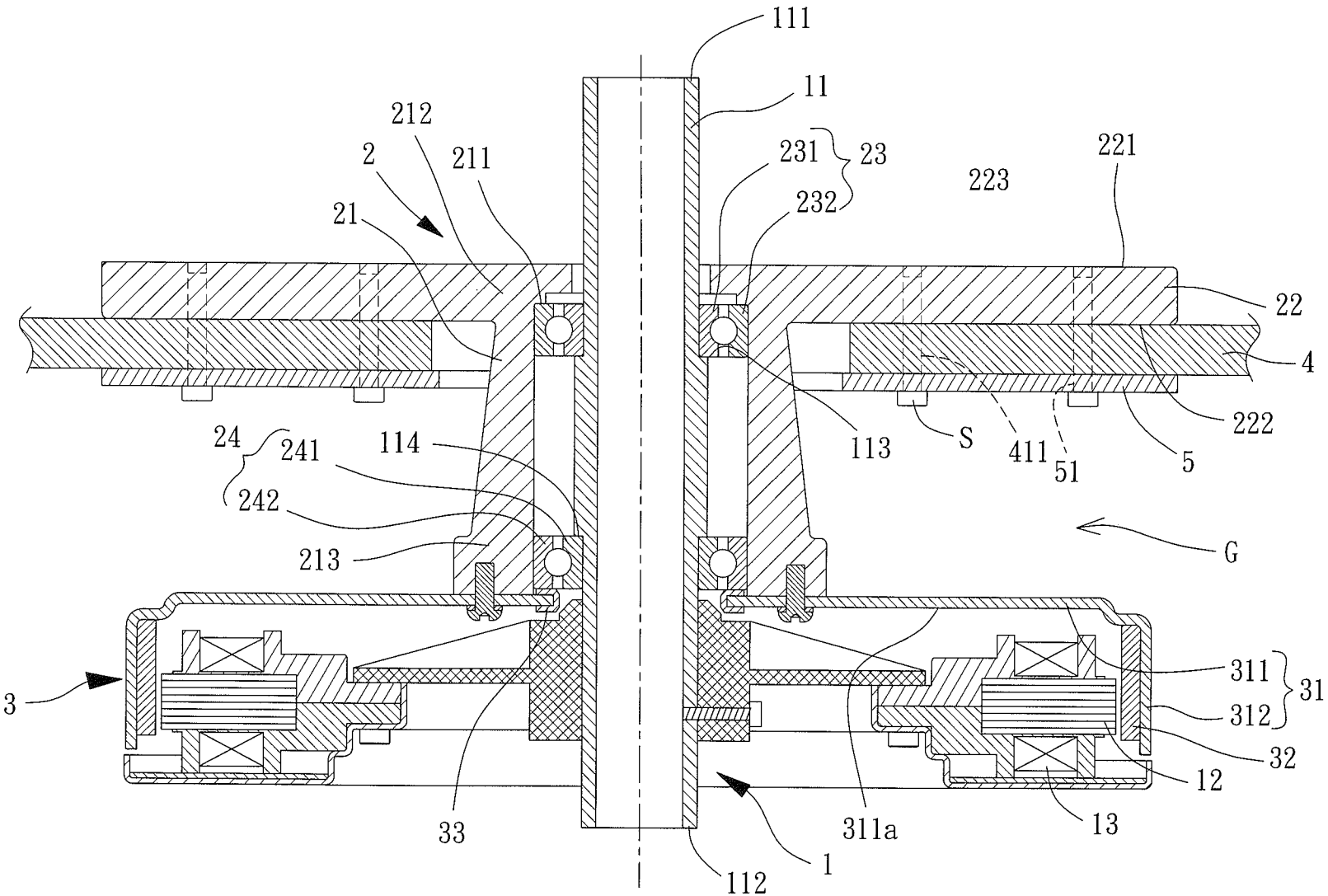
FIG. 6 is a cross sectional view of a ceiling fan according to a fourth embodiment of the invention.

Besides, referring to FIG. 6, in the third and fourth embodiments, when the plurality of blades is coupled with the second surface 222 of the radial extending portion 22, the ceiling fan can also further includes a cover board 5. The cover board 5 abuts against a side of each of the plurality of blades 4 located distant to the second surface 222. In this arrangement, the radial extending portion 22 and the cover board 5 can still clamp each of the plurality of blades 4 from both sides in the axial direction of the shaft 11.

Referring to FIGS. 2 to 6 again, in the previous embodiments, the sleeve 21 may receive a secondary bearing 24. The shaft 11 includes another shoulder portion 114 facing the second end 112. The secondary bearing 24 also includes an inner ring 241 and an outer ring 242. The inner ring 241 is coupled with the outer periphery of the shaft 11 and abuts against the other shoulder portion 114. The outer ring 242 is coupled with an inner surface of the sleeve 21. In this regard, the bearing 23 and the secondary bearing 24 are able to jointly support the sleeve 21, so as to increase the weight capacity of the sleeve 21. In addition, an elastic member 33 is coupled with the inner periphery of the top wall 311 of the hub 31. The elastic member 33 can abut against a surface of the outer ring 242 facing the second end 112. As such, the elastic member 33 and the other shoulder portion 114 of the shaft 11 are able to provide a preload force for the secondary bearing 24 from both sides. Namely, the retaining portion 211 of the sleeve 21 and the elastic member 33 can clamp the bearing 23 and the secondary bearing 24 from both sides, assuring that the bearing 23 and the secondary bearing 24 can be firmly coupled between the shaft 11 and the sleeve 21.

Figure 7:
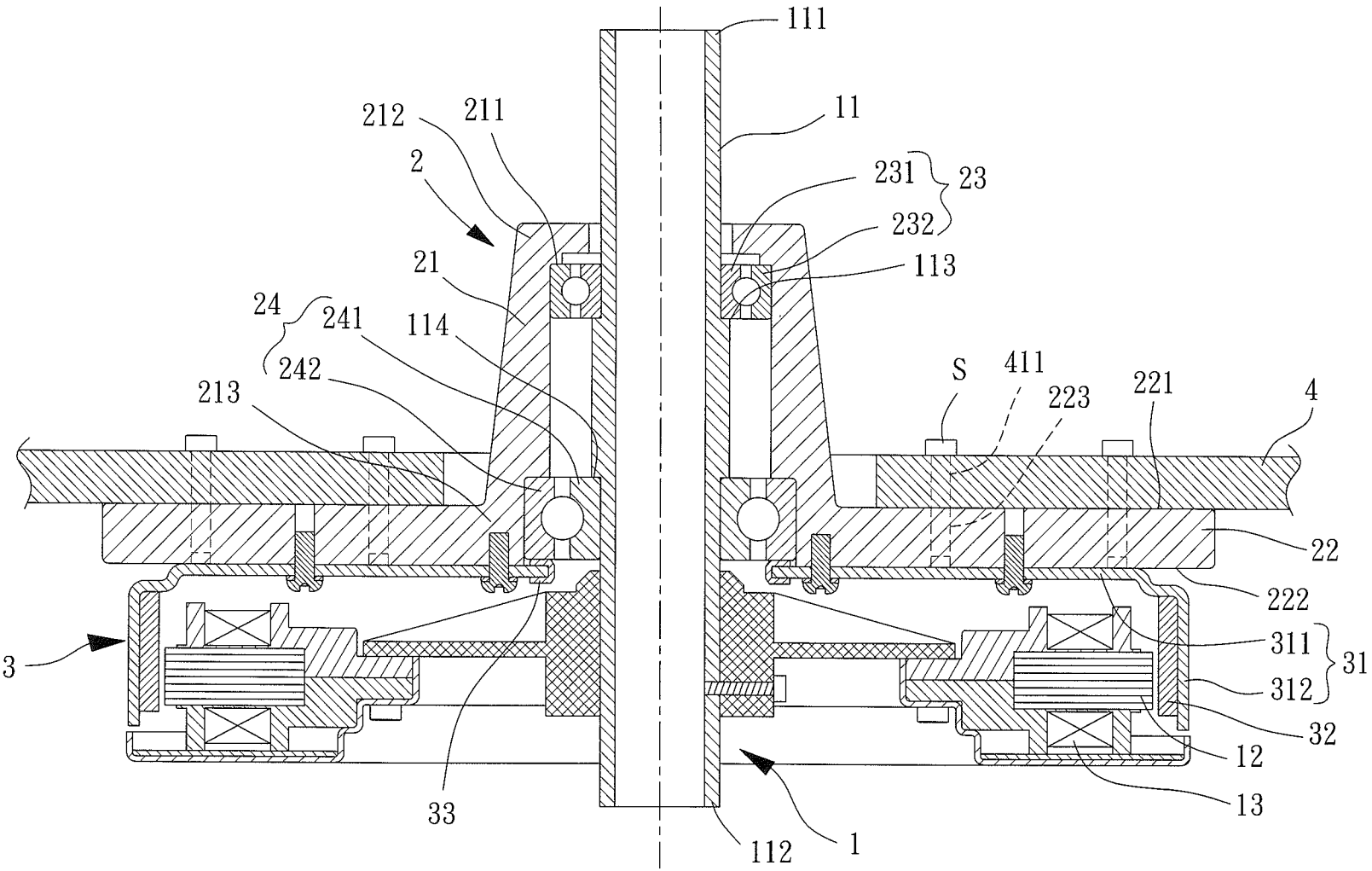
FIG. 7 is a cross sectional view showing a bearing and a secondary bearing in different models according to the invention.

The bearing 23 and the secondary bearing 24 may be bearings in the same model. However, in another implementation shown in FIG. 7, the bearing 23 and the secondary bearing 24 may be bearings in different models. For example, the sizes of the bearing 23 and the secondary bearing 24 may be different, allowing the sizes of the bearing 23 and the secondary bearing 24 to be chosen unrestrainedly according to weight capacity or rotation speed of the ceiling fan according to the embodiment of the invention. In addition, the size of the secondary bearing 24 may be larger than the size of the bearing 23 in this implementation. As such, the secondary bearing 24 is able to come into contact with the retaining portion 211 of the sleeve 21 and absorb the power of the loading plate 2 and the rotor 3 during falling if the outer ring 232 of the bearing 23 broke and dropped, reducing the potential damage to the ceiling fan.

Figure 8:
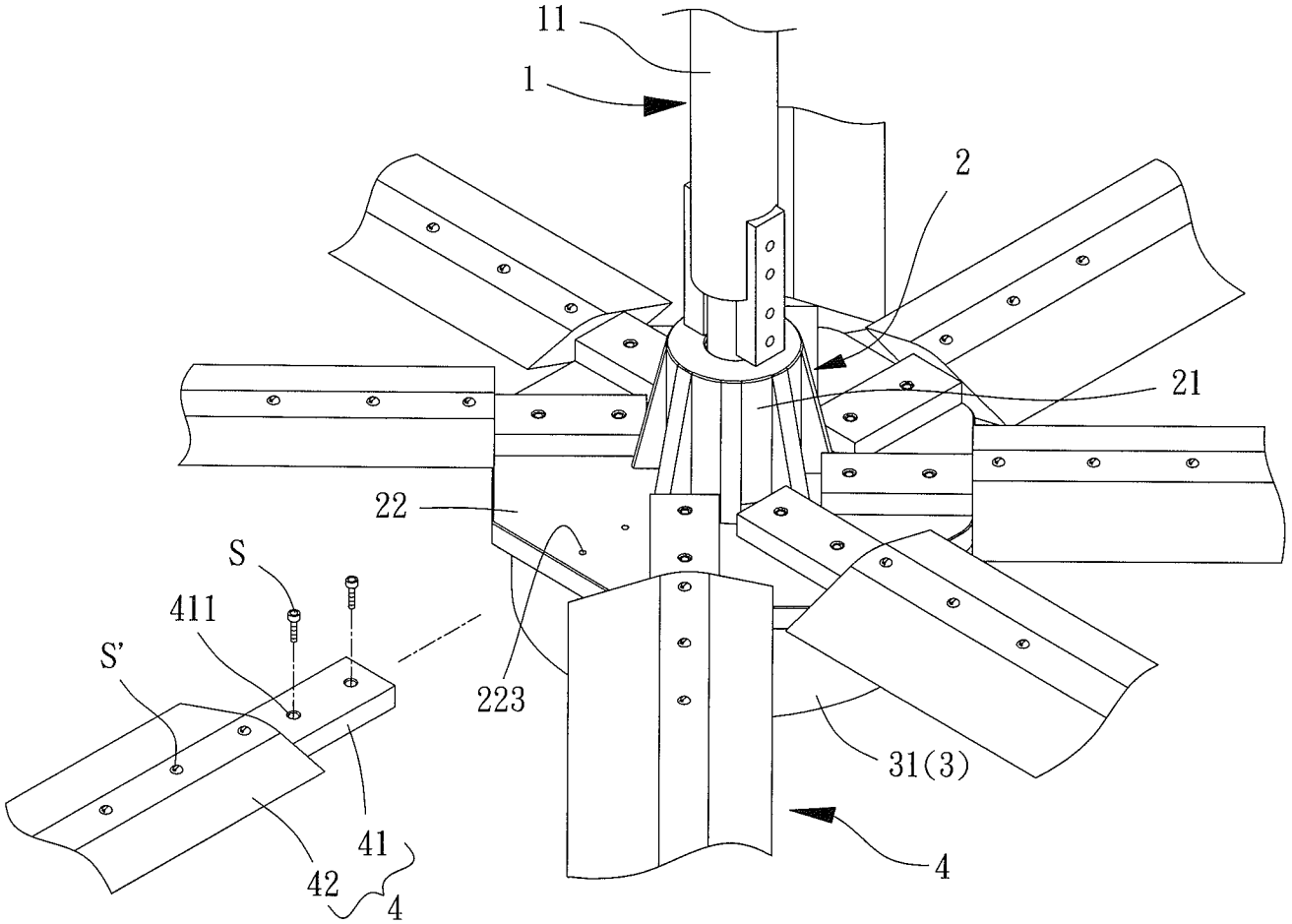
FIG. 8 is a partial, exploded view of a ceiling fan according to a fifth embodiment of the invention.

Referring to FIG. 8, a ceiling fan according to a fifth embodiment of the invention is shown. The fifth embodiment differs from the previous embodiments in that each of the plurality of blades 4 includes a fixing portion 41 and an air driving portion 42. A section of the fixing portion 41 is coupled with the radial extending portion 22 of the loading plate 2, and another section of the fixing portion 41 extends outward beyond the radial extending portion 22 to couple with the air driving portion 42. Specifically, the second coupling portion 411 of each of the plurality of blades 4 may form on the fixing portion 41, enabling the fixing portion 41 to couple with one of the plurality of first coupling portions 223 of the radial extending portion 22 via the second coupling portion 411. In this arrangement, each of the plurality of blades 4 can be coupled with the radial extending portion 22 via the fixing portion 41, thereby preventing the thickness or shape of the air driving portion 42 from limiting by the radial extending portion 22. Therefore, the production complexity of the plurality of blades 4 can be reduced.

Figure 9:
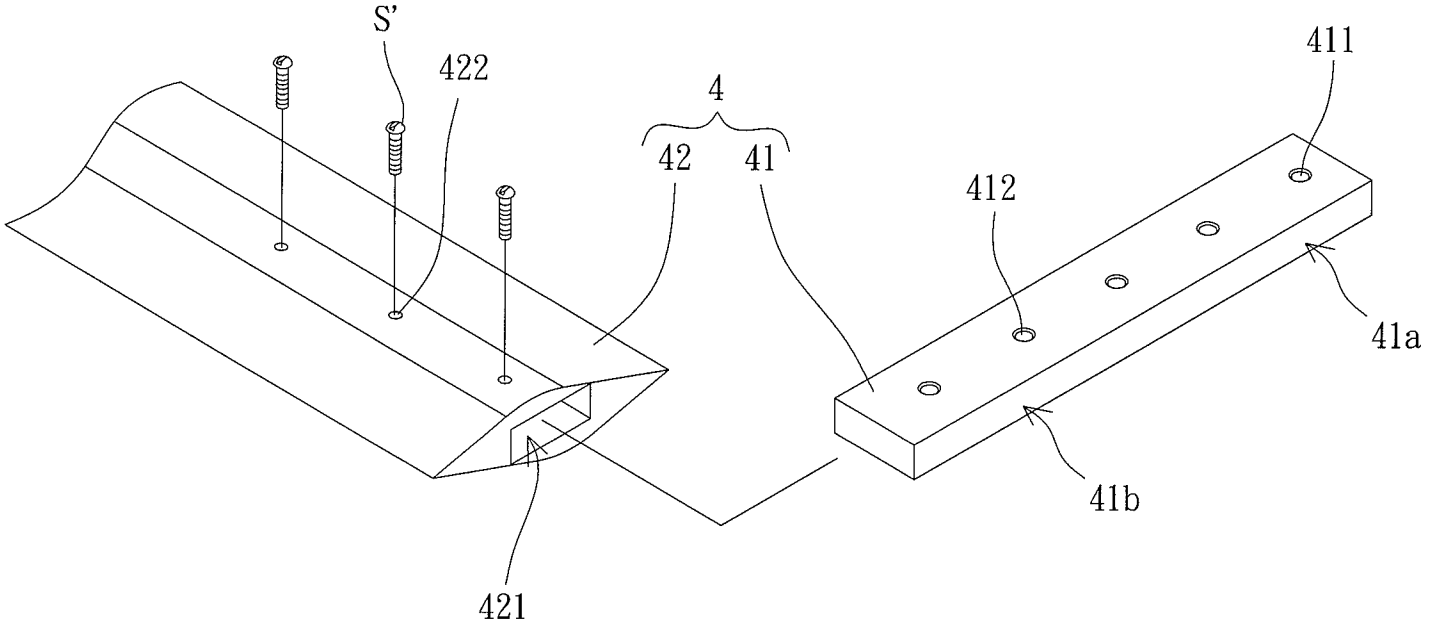
FIG. 9 is an exploded view of a blade of the ceiling fan according to the fifth embodiment of the invention.

Please also refer to FIG. 9, in the fifth embodiment, the air driving portion 42 includes a receiving portion 421. The receiving portion 421 has an opening facing the loading plate 2, and the fixing portion 41 extends into the receiving portion 421. Specifically, the fixing portion 41 has a first section 41*a* and a second section 41*b*. The first section 41*a* is the section of the fixing portion 41 coupled with the radial extending portion 22, and the second section 41*b* is the other section of the fixing portion 41 extending beyond the radial extending portion 22 to couple with the air driving portion 42. Therefore, the first section 41*a* is exposed out of the air driving portion 42, and the second section 41*b* is received inside the receiving portion 421. The second coupling portion 411 is formed on the first section 41*a* of the fixing portion 41. The second section 41*b* has a first assembling portion 412. Correspondingly, the air driving portion 42 has a second assembling portion 422 able to couple with the first assembling portion 412. For example, the first assembling portion 412 and the second assembling portion 422 may be through holes in alignment with each other, allowing another fixing member "S'" to extend through the first and second assembling portion 412, 422. As such, the second section 41*b* is able to couple with the air driving portion 42 by way of screwing.

By such an arrangement, the first section 41*a* of the fixing portion 41 is able to couple with the radial extending portion 22, and the second section 41*b* of the fixing portion 41 is able to extend into the receiving portion 421 and to couple with the air driving portion 42, so as to enhance the structural strength of the combination between the fixing portion 41 and the air driving portion 42. Besides, at least a part of the air driving portion 42 is hollow by providing the receiving portion 421 on the air driving portion 42 for receiving the second section 41*b*. As such, the weight of each of the plurality of blades 4 is reduced, advantageously reducing the manufacturing cost of each of the plurality of blades 4 and the total weight of the ceiling fan.

Furthermore, the air driving portion 42 may be a hollow plate formed by aluminum extrusion. In this arrangement, it requires only one aluminum extrusion die to produce the air driving portions 42 with different lengths by aluminum extrusion and shearing processes. As such, different types of the blades 4 (with different lengths) can be simply produced by coupling the fixing portion 41 with the air driving portions 42 of different lengths, significantly reducing the cost required to produce various types of the blades 4 (with different lengths). Thus, the ceiling fan according to the fifth embodiment of the invention can implement different types of the products in order to meet the need of different applications.

Figure 10:
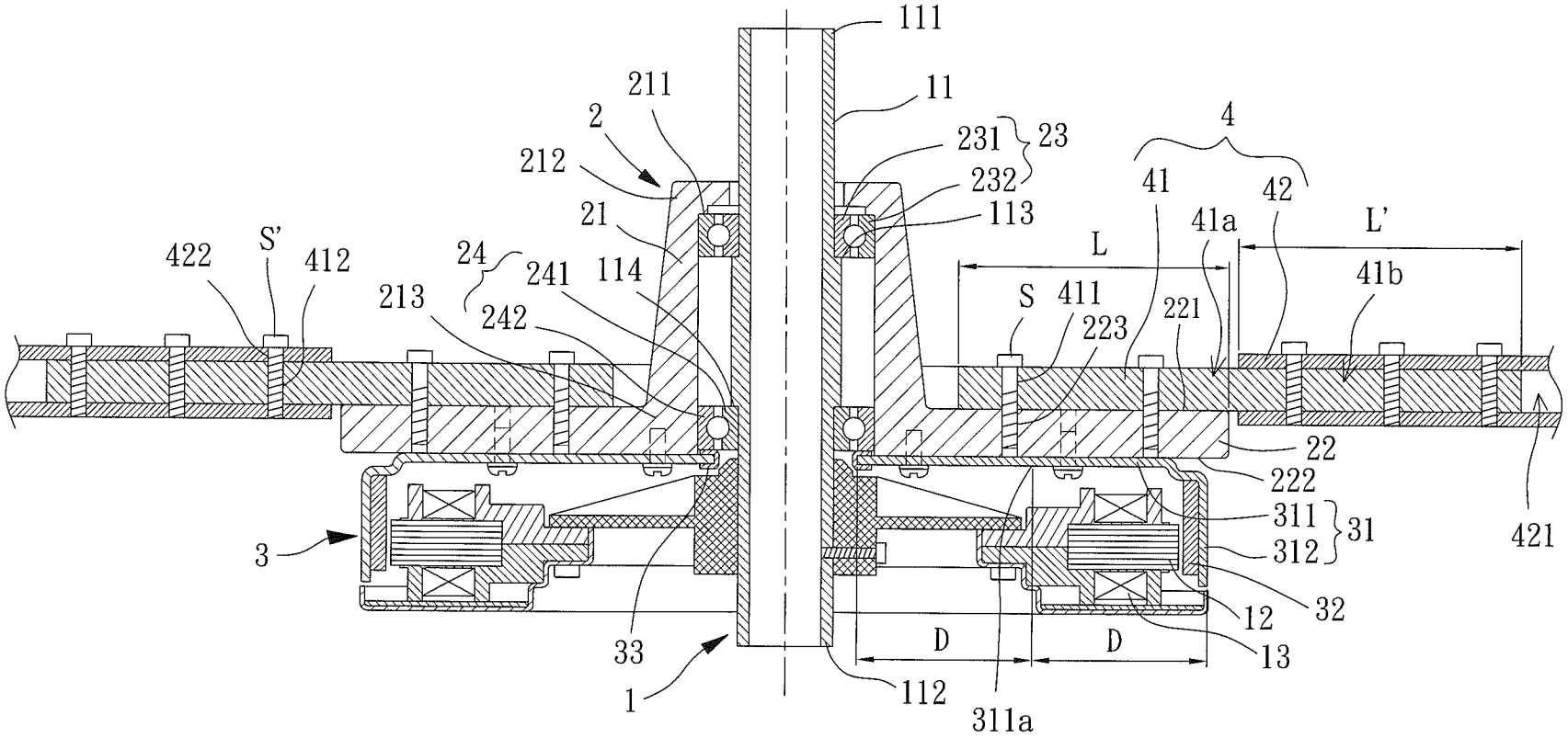
FIG. 10 is a cross sectional view of a ceiling fan according to a fifth embodiment of the invention.

Please refer to FIG. 10, in the fifth embodiment, each of the plurality of blades 4 is coupled with the radial extending portion 22 via the first section 41*a* of the fixing portion 41. In the extending direction of each of the plurality of blades 4, an overlap between the first section 41*a* and the radial extending portion 22 also has the length "L", and the second section 41*b* of the fixing portion 41 has an extending length "L'". The extending length "L'" is the length of the overlap between the fixing portion 41 and the air driving portion 42. The length "L" may be larger than the distance "D" as stated above. Besides, the length "L" may also be larger than the extending length "L'". As such, the contact area between each of the plurality of blades 4 and the radial extending portion 22 is larger, and the moment of force received by first section 41*a* is reduced, preventing the coupling effect between the second coupling portion 411 and the first coupling portions 223 of the radial extending portion 22 from decreasing.

Figure 11:
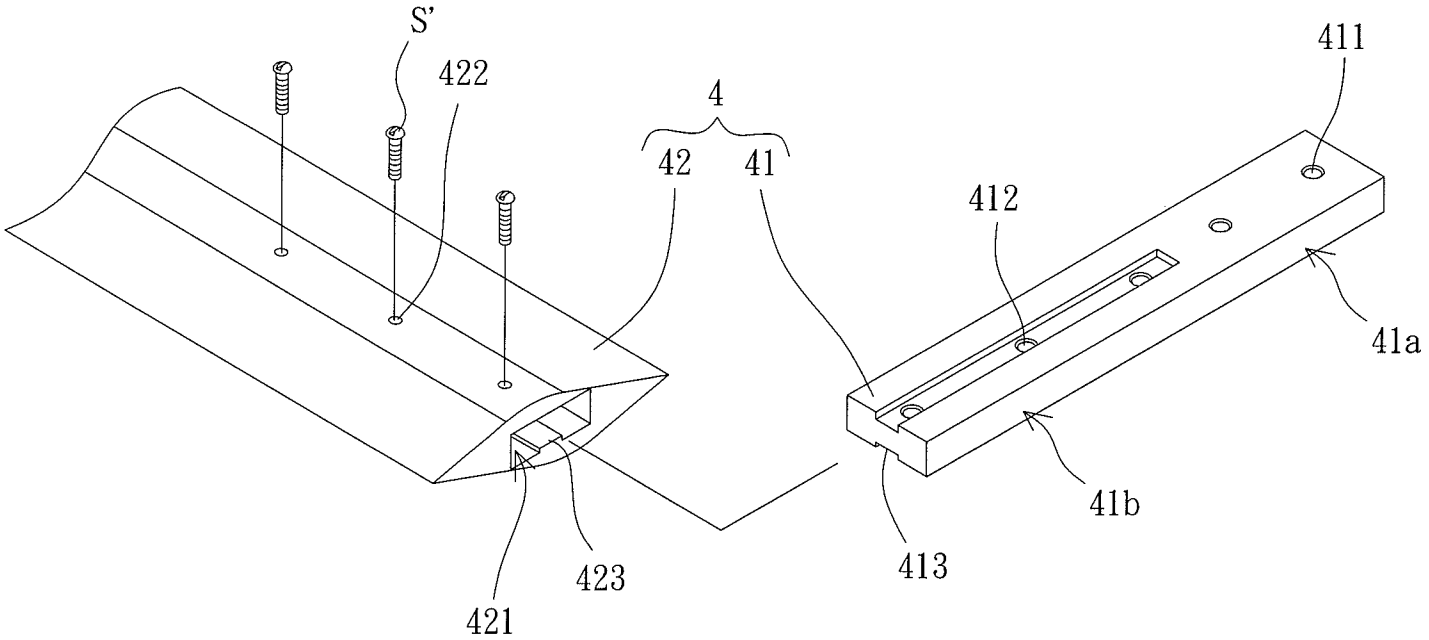
FIG. 11 is an exploded view showing a blade with positioning members according to an implementation of the invention.

In an implementation shown in FIG. 11, the second section 41*b* of the fixing portion 41 has a first positioning member 413, an inner surface of the air driving portion 42 facing the receiving portion 421 has a second positioning member 423. The first positioning member 413 and the second positioning member 423 respectively extend in the extending direction of each of the plurality of blades 4, and the first positioning member 413 is movably coupled with the second positioning member 423. For example, the first positioning member 413 may be a groove, and the second positioning member 423 may be a protrusion in a shape corresponding to the groove. Therefore, the first positioning member 413 is able to tenon the second positioning member 423. As such, the first and second positioning members 413, 423 are able to limit a direction in which the relative move between the fixing portion 41 and the air driving portion 42 can be made, thereby allowing the second section 41*b* of the fixing portion 41 to easily extend into the receiving portion 421 of the air driving portion 42, and further providing a convenient assembly of each of the plurality of blades 4.

Figure 12:
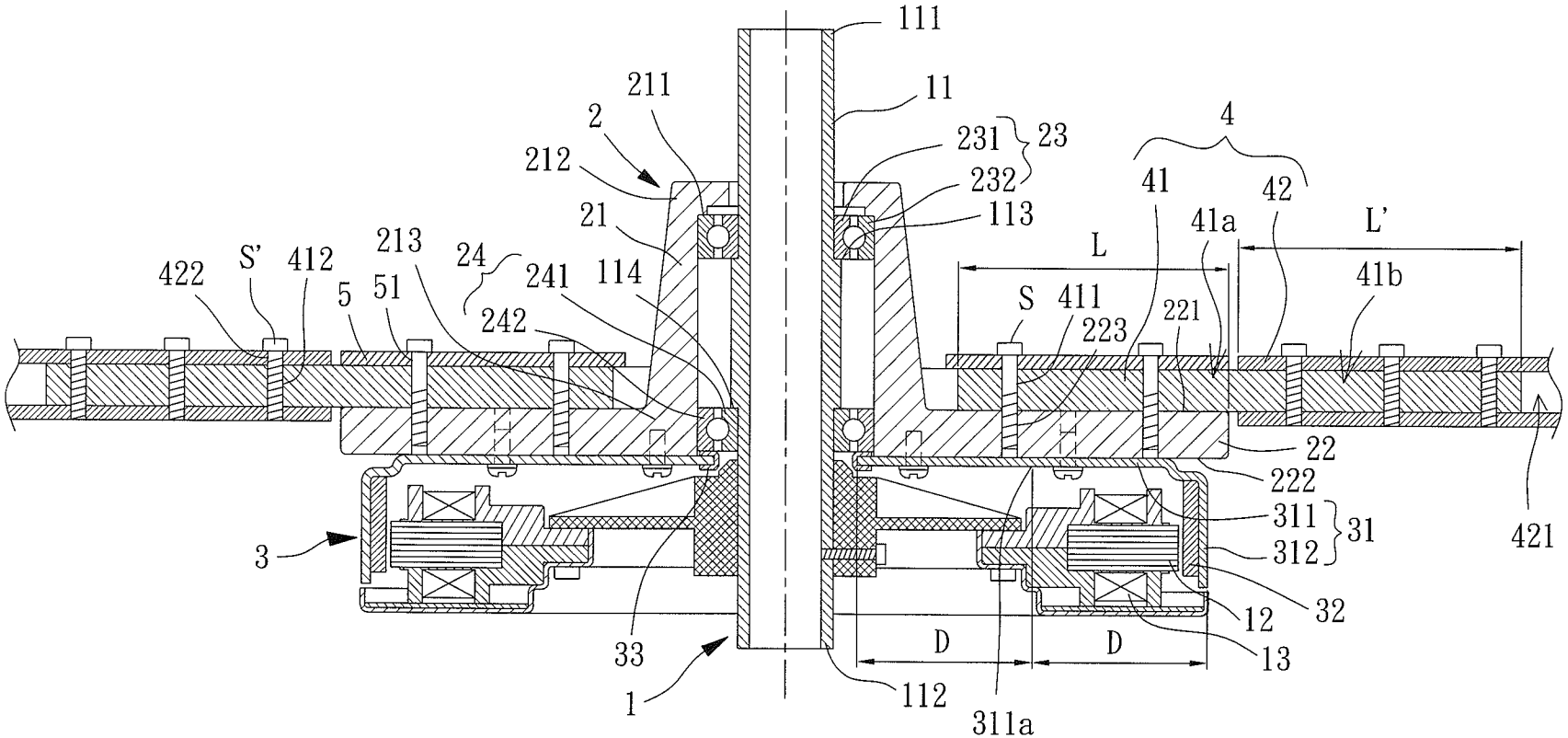
FIG. 12 is a cross sectional view showing a cover board abutting against a fixing portion of each of the plurality of blades.

Similar to the those of the second embodiment, in another implementation shown in FIG. 12, the ceiling fan also includes a cover board 5. The cover board 5 abuts against a side of the fixing portion 41 of each of the plurality of blades 4 located distant to the radial extending portion 22. In this arrangement, the radial extending portion 22 and the cover board 5 can clamp the fixing portion 41 of each of the plurality of blades 4 from both sides in the axial direction of the shaft 11, enhancing the coupling effect between each of the plurality of blades 4 and the radial extending portion 22.

In summary, through the arrangement of the radial extending portion 22 on the loading plate 2, the plurality of blades 4 is directly coupled with the radial extending portion 22. In this regard, the weight supported by the hub 31 of the rotor 3 is reduced. In comparison with the conventional ceiling fan 9, whose hub 921 has to support the total weight of the plurality of blades 94 and thus heavy weight supported by the hub 921 may cause the interconnected part between the hub 921 and the sleeve 93 to come loose or deformed, it is unnecessary for the hub 31 of the present invention to support the weight of the plurality of blades 4 since the plurality of blades 4 is coupled with the loading plate 2. As a result, the interconnected part between the hub 31 and the sleeve 21 of the loading plate 2 will not come loose or deformed due to the weight supported by the hub 31. Therefore, the structural strength of the ceiling fan is enhanced, as well as the service life of the ceiling fan is prolonged.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A ceiling fan comprising:

a stator including a shaft;

a loading plate including a sleeve and a radial extending portion, wherein the radial extending portion radially extends outwards in radial directions of the shaft, wherein the sleeve receives a bearing and a secondary bearing which are coupled with an outer periphery of the shaft;

a rotor including a hub coupled with the loading plate, wherein the loading plate, the bearing and the secondary bearing are located on a same side of the rotor; and a plurality of blades coupled with the radial extending portion.

2. The ceiling fan as claimed in claim 1, wherein the shaft includes a first end, a second end and a shoulder portion with a surface facing the first end, and wherein the bearing is coupled with the shoulder portion.

3. The ceiling fan as claimed in claim 2, wherein the bearing includes an inner ring and an outer ring, wherein the inner ring is coupled with the outer periphery of the shaft and abuts against the shoulder portion, and wherein the outer ring is coupled with the sleeve.

4. The ceiling fan as claimed in claim 1, wherein the shaft includes a first end and a second end, and wherein the hub is coupled with a surface of the sleeve adjacent to the second end.

5. The ceiling fan as claimed in claim 4, wherein a side of the sleeve adjacent to the first end has a first lateral edge, wherein another side of the sleeve has a second lateral edge, and wherein the radial extending portion is formed on the second lateral edge.

6. The ceiling fan as claimed in claim 5, wherein a first surface and a second surface are respectively formed on two sides of the radial extending portion in an axial direction of the shaft, wherein the first surface and the second surface respectively face the first end and the second end, wherein the hub is coupled with the second surface, and wherein the plurality of blades is coupled with the first surface.

7. The ceiling fan as claimed in claim 4, wherein a first surface and a second surface are respectively formed on two sides of the radial extending portion in an axial direction of the shaft, wherein the first surface and the second surface respectively face the first end and the second end, wherein the second surface is spaced from the hub by a gap, and wherein the plurality of blades is coupled with one of the first surface and the second surface.

8. The ceiling fan as claimed in claim 7, wherein a side of the sleeve adjacent to the first end has a first lateral edge, wherein another side of the sleeve has a second lateral edge, and wherein the radial extending portion is arranged between the first lateral edge and the second lateral edge.

9. The ceiling fan as claimed in claim 7, wherein a side of the sleeve adjacent to the first end has a first lateral edge, wherein another side of the sleeve has a second lateral edge, and wherein the radial extending portion is formed on the first lateral edge.

10. The ceiling fan as claimed in claim 6, further comprising a cover board, wherein the cover board abuts against a side of each of the plurality of blades located distant to the radial extending portion.

11. The ceiling fan as claimed in claim 10, wherein the cover board fully or partially covers an overlap between each of the plurality of blades and the radial extending portion.

12. The ceiling fan as claimed in claim 7, further comprising a cover board, wherein the cover board abuts against a side of each of the plurality of blades located distant to the radial extending portion.

13. The ceiling fan as claimed in claim 12, wherein the cover board fully or partially covers an overlap between each of the plurality of blades and the radial extending portion.

14. The ceiling fan as claimed in claim 1, wherein the radial extending portion includes a plurality of first coupling portions, wherein each of the plurality of blades includes a second coupling portion, and wherein each of the plurality of first coupling portions is coupled with the second coupling portion of a respective one of the plurality of blades.

15. The ceiling fan as claimed in claim 14, further comprising a cover board, wherein the cover board abuts against a side of each of the plurality of blades located distant to the radial extending portion, wherein the cover board includes a plurality of third coupling portions, and wherein each of the plurality of third coupling portions is coupled with a respective one of the plurality of first coupling portions and the second coupling portion of a respective one of the plurality of blades.

16. The ceiling fan as claimed in claim 15, wherein the first coupling portion has a screw hole, wherein each of the second coupling portion and the third coupling portion has a through hole, wherein a fixing member extends through the through holes of the second coupling portion and the third coupling portion, and wherein the fixing members is coupled with a wall of the screw hole of the first coupling portion.

17. The ceiling fan as claimed in claim 1, wherein the hub includes a top wall and a lateral wall formed on an outer periphery of the top wall, wherein the top wall has a midpoint in one of the radial directions of the shaft, wherein the midpoint is located at the middle of the outer periphery and an inner periphery of the top wall, and wherein the radial extending portion extends outward beyond the midpoint in the radial direction.

18. The ceiling fan as claimed in claim 17, wherein each of the plurality of blades has an extending direction, wherein an overlap between each of the plurality of blades and the radial extending portion has a length in the extending direction, and wherein the length is larger than a distance between the midpoint and the outer periphery of the top wall.

19. The ceiling fan as claimed in claim 2, wherein the shaft includes another shoulder portion with a surface facing the second end, wherein the secondary bearing is coupled with the other shoulder portion, and wherein a size of the secondary bearing is larger than a size of the bearing.

20. The ceiling fan as claimed in claim 1, wherein each of the plurality of blades includes a fixing portion and an air driving portion, wherein a section of the fixing portion is coupled with the radial extending portion of the loading plate, and wherein another section of the fixing portion extends beyond the radial extending portion to couple with the air driving portion.

21. The ceiling fan as claimed in claim 20, wherein the radial extending portion includes a plurality of first coupling portions, wherein the fixing portion of each of the plurality of blades includes a second coupling portion, and wherein each of the plurality of first coupling portions is coupled with the second coupling portion of the fixing portion of a respective one of the plurality of blades.

22. The ceiling fan as claimed in claim 21, further comprising a cover board, wherein the cover board abuts against a side of the fixing portion of each of the plurality of blades located distant to the radial extending portion, wherein the cover board includes a plurality of third coupling portions, and wherein each of the plurality of third coupling portions is coupled with a respective one of the plurality of first coupling portions and the second coupling portion of the fixing portion of a respective one of the plurality of blades.

23. The ceiling fan as claimed in claim 21, wherein the air driving portion includes a receiving portion having an opening facing the loading plate, and wherein the fixing portion extends into the receiving portion.

24. The ceiling fan as claimed in claim 23, wherein the fixing portion has a first section and a second section, wherein the first section is exposed out of the air driving portion, wherein the second section is received inside the receiving portion, and wherein the second coupling portion is formed on the first section.

25. The ceiling fan as claimed in claim 24, wherein the second section has a first assembling portion, and wherein the air driving portion has a second assembling portion coupled with the first assembling portion.

26. The ceiling fan as claimed in claim 24, wherein each of the plurality of blades has an extending direction, wherein an overlap between the first section of the fixing portion of each of the plurality of blades and the radial extending portion has a length in the extending direction, wherein the second section of the fixing portion has an extending length in the extending direction, wherein the extending length is a length of an overlap between the fixing portion and the air driving portion, and wherein the length is larger than the extending length.

27. The ceiling fan as claimed in claim 24, wherein the hub includes a top wall and a lateral wall formed on an outer periphery of the top wall, wherein the top wall has a midpoint in one of the radial directions of the shaft, wherein the midpoint is located at the middle of the outer periphery and an inner periphery of the top wall, wherein the radial extending portion extends beyond the midpoint in the radial direction, and wherein the length is larger than a distance between the midpoint and the outer periphery of the top wall.

28. The ceiling fan as claimed in claim 23, wherein the fixing portion has a first positioning member, wherein an inner surface of the air driving portion facing the receiving portion has a second positioning member, wherein the first positioning member and the second positioning member respectively extend in an extending direction of a respective one of the plurality of blades, and wherein the first positioning member is movably coupled with the second positioning member.

29. The ceiling fan as claimed in claim 23, wherein the air driving portion is a hollow plate formed by aluminum extrusion.

* * * * *